US009675978B2

(12) United States Patent
Rubenstein et al.

(10) Patent No.: US 9,675,978 B2
(45) Date of Patent: Jun. 13, 2017

(54) ATTRITION MILL

(75) Inventors: Joshua Beckh Rubenstein, Gloucester (CA); Gregory Stephen Anderson, Red Hill (AU)

(73) Assignees: Xstrata Technology Pty Ltd, Brisbane (AU); Netzsch-Feinmahltechnik GmbH, Selb (DE)

( * ) Notice: Subject to any disclaimer, the term of this patent is extended or adjusted under 35 U.S.C. 154(b) by 938 days.

(21) Appl. No.: 13/140,276

(22) PCT Filed: Dec. 17, 2009

(86) PCT No.: PCT/AU2009/001644
§ 371 (c)(1),
(2), (4) Date: Sep. 8, 2011

(87) PCT Pub. No.: WO2010/068993
PCT Pub. Date: Jun. 24, 2010

(65) Prior Publication Data

US 2011/0309174 A1 Dec. 22, 2011

(30) Foreign Application Priority Data

Dec. 19, 2008 (AU) ..... 2008906540

(51) Int. Cl.
*B02C 17/16* (2006.01)
*B02C 17/18* (2006.01)

(52) U.S. Cl.
CPC ..... *B02C 17/161* (2013.01); *B02C 17/163* (2013.01); *B02C 17/1835* (2013.01)

(58) Field of Classification Search
CPC ..... B02C 17/16; B02C 17/163; B02C 17/20; B02C 17/205
USPC ..... 241/79, 171, 172, 179, 153, 80
See application file for complete search history.

(56) References Cited

U.S. PATENT DOCUMENTS

| | | | | |
|---|---|---|---|---|
| 3,149,789 | A * | 9/1964 | Szegvari | 241/27 |
| 3,432,109 | A * | 3/1969 | Geissel | 241/172 |
| 4,108,385 | A | 8/1978 | Funk | |
| 5,333,804 | A | 8/1994 | Liebert | 241/69 |

(Continued)

FOREIGN PATENT DOCUMENTS

| | | |
|---|---|---|
| CN | 2249636 Y | 3/1997 |
| CN | 2376334 Y | 5/2000 |

(Continued)

OTHER PUBLICATIONS

International Search Report and Written Opinion, PCT/AU2009/001644, mailed Feb. 11, 2010.

(Continued)

*Primary Examiner* — Matthew G Katcoff
(74) *Attorney, Agent, or Firm* — Winston & Strawn LLP

(57) ABSTRACT

An attrition mill that includes a grinding chamber having a plurality of grinding elements and an internal classification and separation stage. The mill also includes at least one grinding element providing a larger flow path therethrough, when compared to other of the grinding elements. In other embodiments, mill includes at least one grinding element having an open area in the grinding element created to allow a larger flow path as a proportion of the grinding element surface area without such allowance and in the range of from 15% to equal to or less than 100%.

27 Claims, 4 Drawing Sheets

(56) References Cited

U.S. PATENT DOCUMENTS

| | | | | |
|---|---|---|---|---|
| 5,597,126 | A | 1/1997 | Frommherz et al. | 241/172 |
| 5,797,550 | A | 8/1998 | Woodall et al. | |
| 5,984,213 | A | 11/1999 | Woodall et al. | |
| 6,405,952 | B1 * | 6/2002 | Zoz | 241/172 |
| 7,073,738 | B2 * | 7/2006 | Sneeringer et al. | 241/30 |
| 7,226,005 | B2 * | 6/2007 | Jones et al. | 241/21 |
| 2005/0051651 | A1 * | 3/2005 | Enderle | B01F 7/00025 241/172 |

FOREIGN PATENT DOCUMENTS

| | | | | |
|---|---|---|---|---|
| DE | 1 183 344 | | 2/1962 | |
| SU | 447498 | A1 | 10/1974 | |
| TW | DE 3900262 | A1 * | 7/1990 | B02C 17/16 |
| WO | WO 2009/024159 | A1 | 2/2009 | |

OTHER PUBLICATIONS

Supplementary European Search Report, Appl. No. EP 09832722.4, Nov. 10, 2015.

* cited by examiner

ATTRITION MILL

This application is a 371 filing of International Patent Application PCT/AU2009/001644 filed Dec. 17, 2009.

FIELD OF THE INVENTION

The present invention relates to an attrition mill and a method of grinding a material.

BACKGROUND OF THE INVENTION

The term "attrition mill" is herein used to include mills used for fine grinding for example, stirred mills in any configuration such as bead mills, peg mills; wet mills such as colloid mills, fluid energy mills, ultrasonic mills, petite pulverisers, and the like grinders. In general, such mills comprise a grinding chamber and an axial impeller having a series of mainly radially directed grinding elements such as arms or discs, the impeller being rotated by a motor via a suitable drive train. The grinding elements are approximately equally spaced along the impeller by a distance chosen to permit adequate circulation between the opposed faces of adjacent grinding elements and having regard to overall design and capacity of the mill, impeller speed and diameter, grinding element design, mill throughput and other factors.

Such mills are usually provided with grinding media and the source material to be ground is fed to the mill as a slurry. Although the invention is herein described with particular reference to the use of various forms of grinding media added to the mill, it will be understood that the invention may be applied to mills when used for autogenous or semi-autogenous grinding. In the case for example of a stirred mill used for grinding pyrite, arseno-pyrite, or the like, the grinding medium may be spheres, cylinders, polygonal or irregularly shaped grinding elements or may be steel, zircon, alumina, ceramics, silica-sand, slag, or the like. In the case of a bead mill used to grind a sulphide ore (for example galena, pyrite) distributed in a host gangue (for example, shale and/or silica) the gangue may itself be sieved to a suitable size range, for example 1-10 millimeters or 1-4 millimeters, and may be used as a grinding medium. The media size range is dependant on how fine the grinding is required to be. From about 40% to about 95% of the volume capacity of the mill may be occupied by grinding media.

It should be recognized that in the grinding process, grinding media undergoes size reduction as does source material to be ground. Grinding media which is itself ground to a size no longer useful to grind source material is referred to as "spent" grinding media. Grinding media still of sufficient size to grind source material is referred to as "useful" grinding media.

A source material to be ground, for example a primary ore, mineral, concentrate, calcine, reclaimed tailing, or the like, after preliminary size reduction by conventional means (for example to 20-200 microns), is slurried in water and then admitted to the attrition mill through an inlet in the grinding chamber. In the mill, the impeller causes the particles of grinding media to impact with source material, and particles of source material to impact with each other, fracturing the source material to yield fines (for example 0.5-90 microns). It is desirable to separate the coarse material from the fines at the mill outlet so as to retain useful grinding media and unground source material in the mill while permitting the fines and spent grinding media to exit the mill.

In some attrition mills, outlet separation is achieved by means of a perforated or slotted screen at, or adjacent to, the mill exit and having apertures dimensioned to allow passage of spent grinding media and product but not permitting passage of useful grinding media. For example, if it is desired to retain particles of greater than 1 mm in the mill, the outlet screen aperture width would be a maximum of 1 mm so that only particles smaller than 1 mm would exit the mill through the screen. The outlet may in addition comprise a scraper or a separator rotor to reduce screen clogging. The axial spacing between the facing surfaces of the separator rotor and the last downstream grinding element is approximately equal to the spacing between the facing surfaces of all the other pairs of grinding elements.

The design and operation of attrition mills and media selection is highly empirical. Although various mathematical computer-based models have been proposed, none have yielded satisfactory predictions of mill performance.

In attempting to finely grind a sulphide ore using various grinding media in a high throughput bead mill e.g. having a mill throughput of greater than 10 TPH, it was found that the outlet screen rapidly clogged reducing the throughput to an intolerably low level. Moreover, the rate of wear of the separator rotor and outlet screen rendered operation uneconomic.

U.S. Pat. No. 5,797,550, the entire contents of which are incorporated herein by cross reference, describes an attrition mill having improved means for classification and/or separation of coarse particles from fine particles in a slurry. The attrition mill described in this patent comprises a grinding chamber, an axial impeller, a chamber inlet for admitting coarse particles, and a separator comprising a chamber outlet through which fine particles exit from the chamber. The mill is characterised in that a classification between coarse and fine particles is performed in the mill upstream of the separator. By conducting classification between fine and coarse particles upstream from the mill outlet, the maximum size of particles exiting from the mill is substantially independent of the minimum orifice dimensions of the chamber outlet.

Classification may take place in this mill by providing a classifier element defining a first surface in rotation about an axis, a second surface spaced from and facing the first surface so as to define a passage there between, a classifier inlet for admitting slurry to the passage, a first classifier and outlet spaced from the classifier inlet whereby the slurry exits from the passage, a second classifier outlet spaced radially outwardly of the classifier inlet, and means for causing the slurry to flow from the classifier inlet to the first classifier outlet at a predetermined volumetric flow rate. The first surface is spaced sufficiently closely to the second surface and is rotated at sufficient speed so that a majority of the particles in the passage having a mass of less than a predetermined mass remained entrained with slurry flowing into the first classifier outlet and a majority of the particles exceeding a predetermined mass are disentrained and move outwardly from the passage at the second classifier outlet.

The passage may be defined between two members which may be rotated (or counter rotated) independently of the axial impeller and/or of each other.

The attrition mill of this patent may also include a separator stage comprising a separator rotor mounted to the impellor and spaced axially from an endplate to define a radially extending separation passage therebetween, said first classifier outlet admitting slurry to the separation passage at a radially inner region of the separator element, baffle means at or near the separation passage periphery to permit passage of coarse particles travelling outwardly to beyond the separation passage periphery, and a slurry outlet spaced axially from the radially extending separation passage to permit passage of the fine particles out of the mill. The baffle means may be in the form of axial fingers positioned around the periphery of the separator rotor and extending towards the chamber outlet.

The attrition mill described in U.S. Pat. No. 5,797,550 is commercially available from the present applicant and is sold under the trademark ISAMILL™.

It is known that attrition mills, such as the prior art attrition mills described above, include a plurality of grinding discs mounted to a rotating shaft. These grinding discs typically include a series of openings, such as a plurality of equiangularly spaced openings. During use of prior art attrition mills, the slurry circulates through the apertures in the grinding discs and particles also went between facing surfaces of the grinding discs and flung against other particles, against the shaft between the grinding discs, against the disc surfaces and against the mill walls. The slurry circulates a radial direction between the discs and adjacent to the shaft.

The attrition mill is described in U.S. Pat. No. 5,797,550 has proven to be technically and commercially successful.

BRIEF DESCRIPTION OF THE INVENTION

The present invention now provides an improved attrition mill.

In one aspect, the present invention provides an attrition mill having

- a grinding chamber,
- an inlet positioned at or near an upstream end of the grinding chamber,
- an outlet positioned at or near a downstream end of the grinding chamber,
- a plurality of spaced grinding elements in the grinding chamber, the plurality of spaced grinding elements being rotatably driven,
- the plurality of spaced grinding elements including one or more apertures therethrough or spaces therebetween to enable slurry and grinding media to pass through said one or more apertures or spaces to enable passage of the slurry and the grinding media along the grinding chamber,
- a classification and separation stage located at or near a downstream end of the grinding chamber, the classification and separation stage causing fine particles to be separated from coarse particles and passed to the outlet to thereby remove the fine particles from the grinding chamber whilst causing internal recycle of coarse particles back towards an upstream end of the grinding chamber,
- wherein the mill includes at least one grinding element providing a larger flow path therethrough, when compared to other of the grinding elements.

The present invention arose during studies conducted on attrition mills constructed in accordance with U.S. Pat. No. 5,797,550. Although the attrition mill described in this US patent has met with considerable commercial success, these mills may be susceptible to significant variations in flow rate through the mill. For example, changing the flow rate of material being fed to the mill can cause significant movement of media within the mill. In some cases, the media can pass into the classification and separation stage, which may result in loss of grinding media from the mill. This is an undesirable outcome.

Although the present inventors do not fully understand the mechanism involved in the present invention, it has been found that providing at least one grinding element that provides a larger flow path therethrough, when compared to other of the grinding elements, acts to suppress or ameliorate excessive movement of media through the mill when variations in flow rate occur by reducing the superficial velocity allowing the media in the slurry to settle.

In some embodiments, the at least one grinding element that provides a larger flow path therethrough is positioned towards a downstream end of the grinding chamber. For example, if the attrition mill includes eight grinding discs, a grinding disc providing a larger flow path therethrough may be positioned at disc 7, in other cases the larger flow path therethrough may be positioned at disc 6, while in other cases the larger flow path therethrough may be positioned at disc 5 (in these embodiments, disc 1 is positioned near the inlet end of the grinding chamber and disc 8 is positioned near the outlet end of the grinding chamber). In other applications, the disc providing the larger flowpath therethrough may be located at other disc positions in the mill.

In one embodiment, the grinding element that provides a large flow path therethrough may comprise a plurality of radially-extending arms. The grinding element may have two to six radially extending arms extending from a central portion. In some embodiments, the grinding element may have four radially extending arm extending from a central point and may have a shape that is similar to the German World War II medal known as an "iron cross". In some embodiments, the grinding element that provides a large flow path therethrough may comprise a cross-like member.

In other embodiments, the grinding element that provides a large flow path therethrough may comprise a grinding disc having apertures therethrough, with the total open area of the apertures being larger than the open area of the apertures in another of the grinding discs in the mill.

The present inventors have also discovered that the beneficial effects of the present invention, in terms of minimizing the suitability of the mill to excessive movement of media arising from changes in the flowrate of material to the mill can be obtained by providing a mill having one, two or more grinding elements having large flow path therethrough, or indeed by providing the mill with all of the grinding elements having a large flow path therethrough. In some applications the open area in the grinding element created to allow a larger flow path as a proportion of the grinding element's surface area without such allowance can be from 15% to equal to or less than 100%. In some applications the open area in the grinding element created to allow a larger flow path as a proportion of the grinding element's surface area without such allowance can be from 20% to equal to or less than 100%. In some applications the open area in the grinding element created to allow a larger flow path as a proportion of the grinding element's surface area without such allowance can be from 25% to equal to or less than 100%. In some applications the open area in the grinding element created to allow a larger flow path as a proportion of the grinding element's surface area without such allowance can be from 30% to equal to or less than 100%.

Accordingly, in a second aspect, the present invention provides an attrition mill having

- a grinding chamber,
- an inlet positioned at or near an upstream end of the grinding chamber,
- an outlet positioned at or near a downstream end of the grinding chamber, a plurality of spaced grinding elements in the grinding chamber, the plurality of spaced grinding elements being rotatably driven, the plurality of spaced grinding elements including one or more apertures therethrough or spaces therebetween to enable slurry and grinding media to pass through said one or more apertures or spaces to enable passage of the slurry and the grinding media along the grinding chamber, a classification and separation stage located at or near a downstream end of the grinding chamber, the classification and separation stage causing fine particles to be separated from coarse particles and passed to the outlet to thereby remove the fine particles from the grinding chamber whilst causing internal recycle of coarse particles back towards an upstream end of the grinding chamber, wherein the mill includes at least one grinding element having an open area in the grinding element created to allow a larger flow path as a proportion of the grinding element's surface area without such allowance in the range of from 15% to equal to or less than 100%.

In this specification, the percentage open area is calculated as the surface area of the apertures (equivalent to the total size of the apertures) and this is then divided by the difference of the full surface area of the disc without the apertures, minus the area of the central hub.

In the example shown in FIG. 8, the calculation is based on a disc used for an M20 ISAMILL™ and is calculated as:

Area of Full Disc=25434 $mm^2$

Area of Hub=3957 $mm^2$

Area of Apertures=13501 $mm^2$ $$\%\ \text{Open Area} = \text{Area of}\ \frac{\text{Apertures}}{\text{Area of Full Disc} - \text{Area of Hub}} \times 100\%$$

$$\%\ \text{Open Area} = \frac{13501}{25434 - 3957} \times 100\%$$

Open Area=63%.

In FIG. 8, the disc has an outer diameter of 180 mm, the central aperture has a diameter of 71 mm and the openings have a radial length of 45 mm.

DETAILED DESCRIPTION OF THE DRAWINGS

It will be appreciated that the drawings have been provided for the purposes of illustrating preferred embodiments of the present invention. Therefore, it will be understood that the present invention should not be considered to be limited side to the features as shown in the attached drawings.

Figure 1:
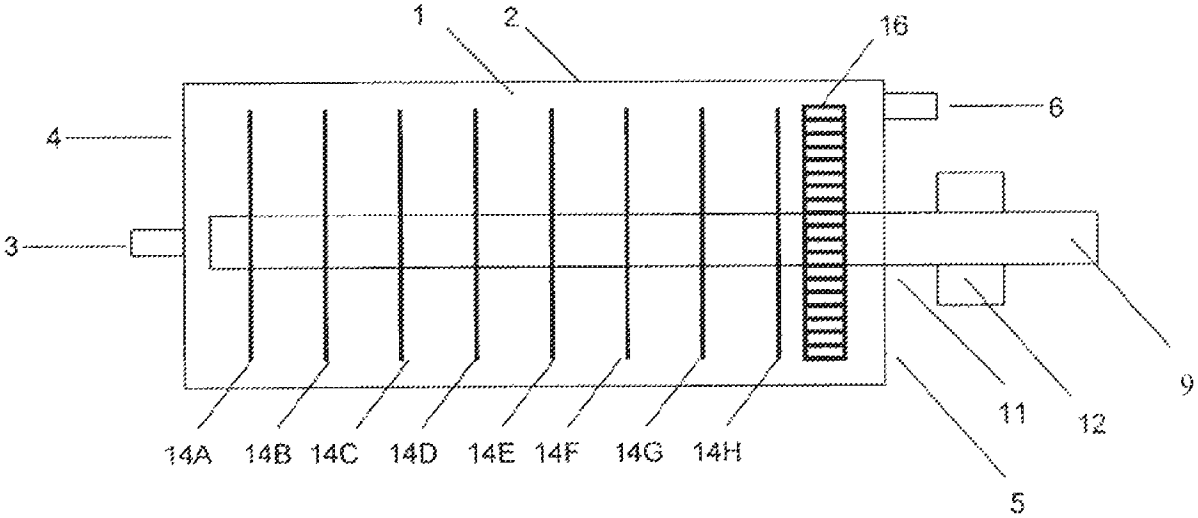
FIG. 1 shows a schematic diagram, partly in cross-section, of an attrition mill in accordance with an embodiment of the present invention.
Figure 2:
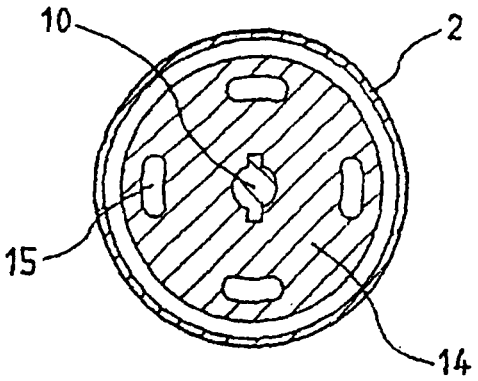
FIG. 2 shows a front view of a conventional grinding disc suitable for use in an embodiment of the present invention.

With reference to FIG. 1 there is shown schematically a prior art attrition mill comprising a grinding chamber 1 defined by a generally cylindrical side wall 2, an inlet end wall 4 and a discharge end wall 5. Chamber 1 is provided with an inlet port 3 and an outlet pipe 6. Chamber 1 is mounted to foundations by means not illustrated. An axial shaft 9 extends through inlet discharge end wall 5 at a sealing device 11. Shaft 9 is driven by a drive train (not illustrated) and is supported by bearing 12. Internally of chamber 1, shaft 9 is fitted with a series of radially directed grinding disks 14 each of which when viewed in plan is seen to be pierced by equiangularly-spaced openings 15 (shown in FIG. 2). In the present example grinding disks 14 are keyed to shaft 9 and each grinding disk 14 is equidistance spaced from adjacent grinding disks 14 to expose the shaft therebetween. As can be seen from FIG. 1, the mill is provided with eight grinding disks, respectively referred to by reference numerals 14A, 14B, . . . 14H.

Figure 3:
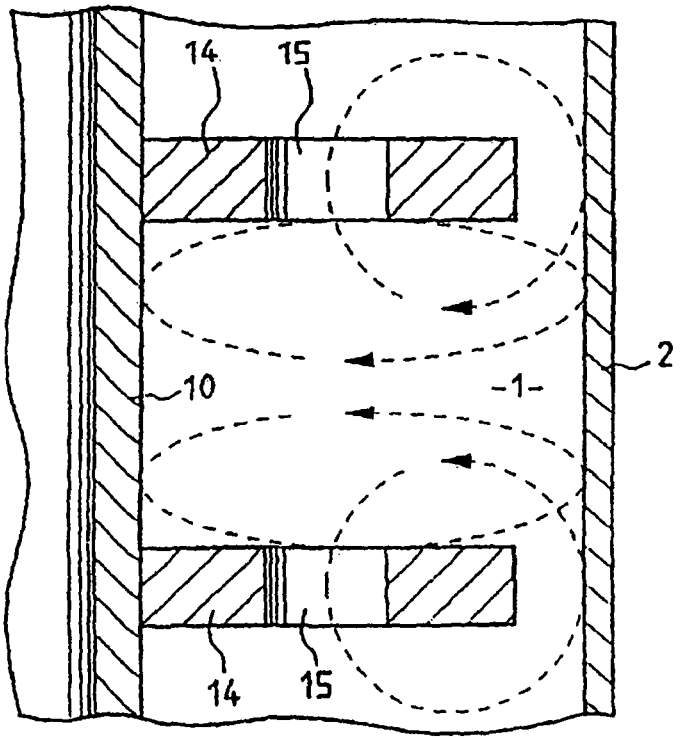
FIG. 3 shows a schematic diagram of a circulation pattern of media and slurry within the attrition mill in the vicinity of the grinding discs.

With reference to FIG. 3 there are shown schematic flow patterns (indicated by arrowed lines) believed to occur in and around adjacent grinding discs 14 of the mill of FIG. 1. Slurry circulates through apertures 15 in grinding discs 14 and particles also enter between facing surfaces of grinding discs 14 and are flung against other particles, against the shaft between grinding discs, against the disc surfaces, and against the mill walls. Slurry circulates in a radial direction between the dics and preferably to adjacent shaft 10. As a result, attrition of the particulate matter fed to the attrition mill occurs, resulting in a size reduction of the particulate material. The mill will also be typically provided with a grinding media to facilitate size reduction. The grinding media may comprise steel balls, ceramic particles, sand or indeed any other grinding media known to be suitable to a person skilled in the art. If the mill is an autogenous mill, a separate grinding media will not be present.

The mill shown in FIG. 1 also includes a classification and separation stage 16 which provides an internal classification of particles. The classification and separation stage 16 may be as described in U.S. Pat. No. 5,797,550, the entire contents of which are herein incorporated by cross reference. The classification and separation stage 16 classifies and separates relatively coarse particles in the mill from relatively fine particles. The fine particles are sent to the mill outlet and exit the mill whilst the coarse particles are effectively recycled internally in the mill and move back towards the inlet end of the mill, so that they may be subject to further grinding or attrition.

The mill shown schematically in FIG. 1 is commercially available from the present applicant and is sold under the trademark ISAMILL™. Persons skilled in the art of attrition or grinding will readily understand how such a mill is constructed and operates.

In presently available ISAMILL™, each of the grinding discs 14A to 14H are essentially identical to each other.

However, the present inventors have found that attrition mills having this configuration may be susceptible to significant movement of the media within the mill if the flowrate of material being fed to the mill varies. To overcome this difficulty, the present inventors have found that replacing one or more of the grinding discs with grinding discs having a larger flow area therethrough (than grinding discs presently being used in such mills) achieves a reduction in movement of media through the mill.

Figure 4:
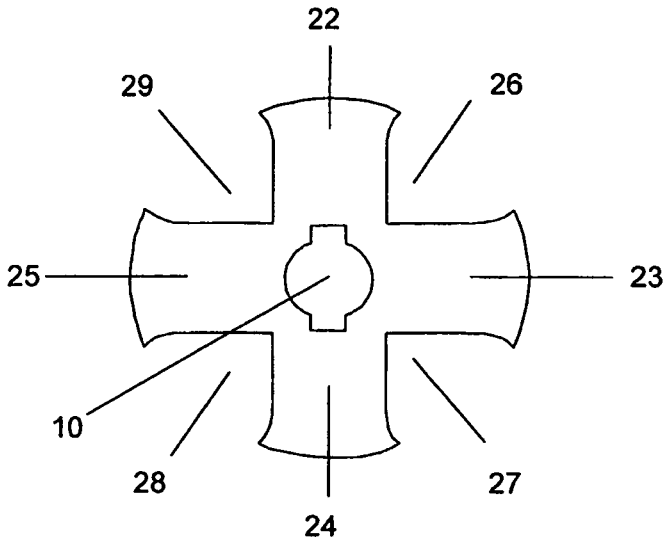
FIG. 4 shows a front view of a grinding disc in the form of an iron cross suitable for use in an embodiment of the present invention.

FIG. 4 shows a schematic diagram of one possible replacement grinding disc suitable for use in an embodiment of the present invention. The grinding disc 20 in FIG. 4 includes a central aperture 10 that is similar to the disc shown in FIG. 2. This aperture allows the disc 20 to be mounted onto the shaft 9. The disc includes a central portion 21 that surrounds the central aperture 10. The disc has four arms 22, 23, 24 and 25 extending radially outwardly from the central portion 21. The disc 20 shown in FIG. 4 has a flow path therethrough that is defined by the spaces 26, 27, 28 and 29 between the adjacent arms 22 to 25. As can be seen by comparing FIG. 4 with FIG. 2, the spaces provide a much larger combined area than the open area provided by the apertures 15 in FIG. 2.

Figure 5:
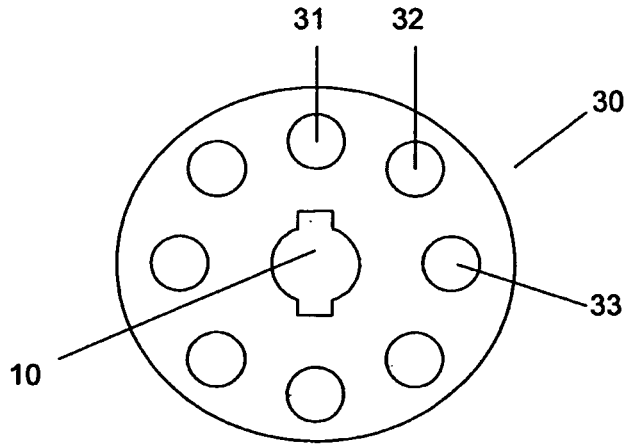
FIG. 5 shows a front view of another grinding disc having a larger flow area therethrough suitable for use in an embodiment of the present invention.

FIG. 5 shows a schematic view of another disc that may be used in embodiments of the present invention. The disc 30 shown in FIG. 5 includes a central aperture 10. However, this disc also includes a plurality of apertures 31, 32, 33, etc. The disc 30 shown in FIG. 5 has more apertures than the shown in FIG. 2. Furthermore, the apertures of the disc 30 in FIG. 5 are larger than the apertures 15 in the disks 14 of FIG. 2. Therefore, the disc 30 of FIG. 5 provides a disc having a larger flow path for slurry therethrough when compared with the disc 14 shown in FIG. 2.

Figure 6:
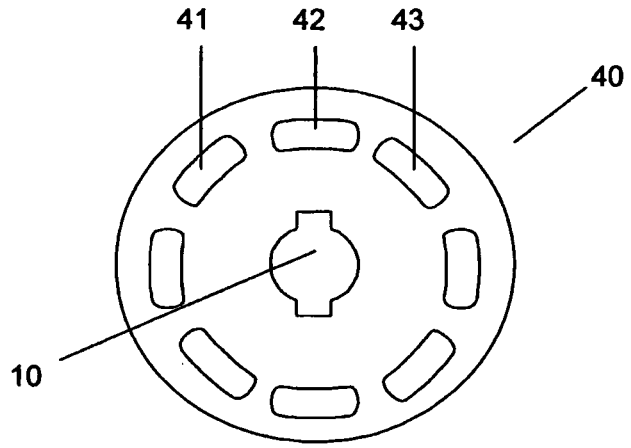
FIG. 6 shows a front view of yet another grinding disc having a larger flow area therethrough suitable for use in an embodiment of the present invention.
Figure 8:
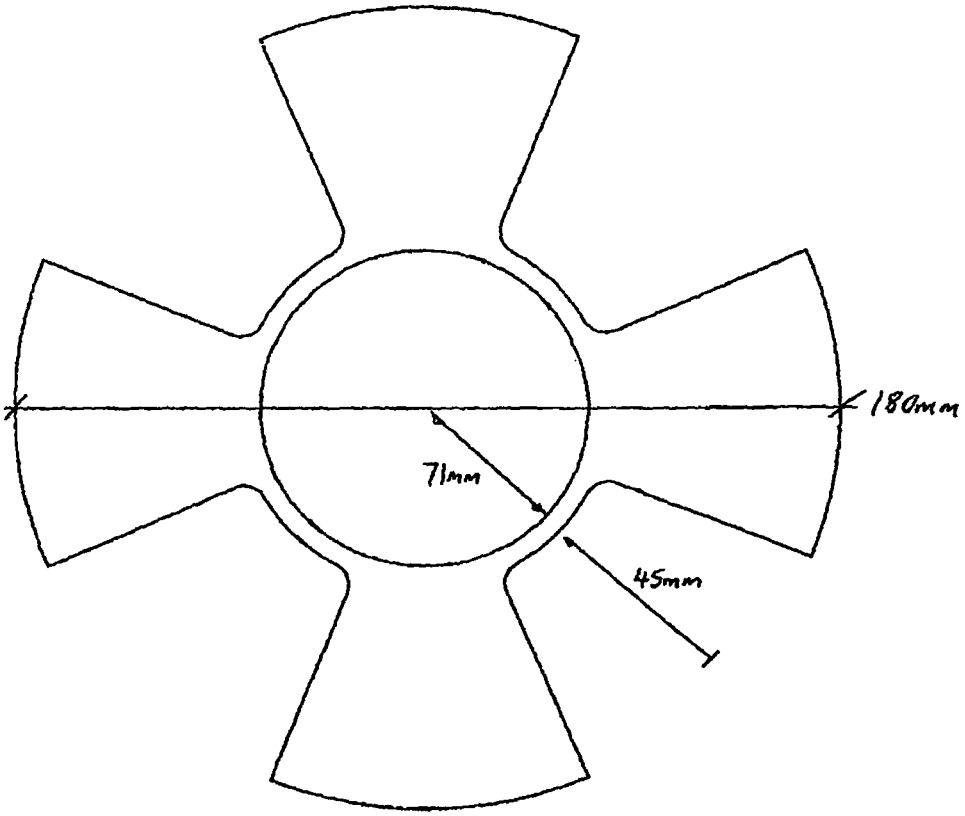
FIG. 8 shows a front view of a grinding disc used in the example of calculating the open area, as given above.

FIG. 6 shows a schematic view of another disc suitable for use in an embodiment of the present invention. In the embodiment shown in FIG. 6, the disc 40 includes a plurality of apertures 41, 42, 43, etc. Each of these apertures 41, 42, 43 is largely identical to the apertures 15 of the disc 14 shown in FIG. 2. However, the disc 40 shown in FIG. 6 has a larger number of apertures than the disc 14 shown in FIG. 2.

In embodiments of the present invention, the disc that provides a larger flow path therethrough may be placed at the position of disc 14G, as shown in FIG. 1. In other embodiments the disc that provides a larger flow path therethrough may be placed in any other position from disc 14A to 14H. Alternatively, two or more of the discs shown in FIG. 1 may be replaced by discs as shown in any of FIGS. 4 to 6. Indeed, in some embodiments, all of the discs 14A to 14H shown in FIG. 1 may be replaced with the discs as shown in any one of FIGS. 4 to 6.

Figure 7:
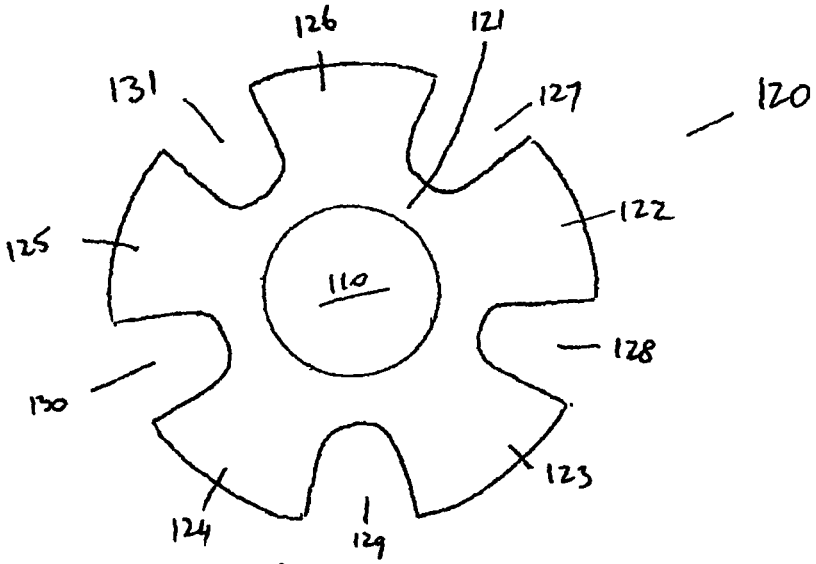
FIG. 7 shows a front view of another grinding disc having a larger flow area therethrough suitable for use in an embodiment of the present invention.

FIG. 7 shows a schematic diagram that is similar to that shown in FIG. 4 but with 5 arms instead of 4 arms. The grinding disc 120 in FIG. 7 includes a central aperture 110 that is similar to the disc shown in FIG. 2. This aperture allows the disc 120 to be mounted onto the shaft 9. The disc includes a central portion 121 that surrounds the central aperture 110. The disc has five arms 122, 123, 124, 125 and 126 extending radially outwardly from the central portion 121. The disc 120 shown in FIG. 7 has a flow path therethrough that is defined by the spaces 127, 128, 129, 130 and 131 between the adjacent arms 122 to 126. As can be seen by comparing FIG. 7 with FIG. 2, the spaces provide a much larger combined area than the open area provided by the apertures 15 in FIG. 2.

Those skilled in the art will appreciate that the present invention may be susceptible to variations and modifications other than those specifically described. It will be understood that the present invention encompasses all such variations and modifications that fall within its spirit and scope.

What is claimed is:

1. An attrition mill that includes an internal structure and grinding media for grinding particles into coarse and fine particles and classifying and separating the fine particles from the coarse particles using a classification and separation stage in which fine particles are separated from coarse particles and removed from the mill along its length and coarse particles are recycled internally in the mill, the attrition mill comprising:

a grinding chamber having an elongated cylindrical side wall, an inlet positioned at or near an upstream end of the grinding chamber, an outlet positioned at or near a downstream end of the grinding chamber, an axial shaft located in the grinding chamber and extending in a direction from the upstream end to the downstream end, the axial shaft being rotatably driven, a plurality of spaced grinding elements in the grinding chamber, each of the plurality of spaced grinding elements being concentrically mounted radially and in a perpendicular orientation relative to the axial shaft, each element being spaced from an adjacent element, each element having a front face that is perpendicular to the axial shaft and including one or more apertures or spaces therein to provide a flow path through each element for slurry and grinding media, each aperture having side walls extending from the front face of the element to a rear face of the element, the side walls being generally perpendicular to the front face, the axial shaft being exposed in between each of the elements thereby allowing passage of slurry and grinding media along and through the grinding chamber from the inlet to the outlet in a direction from the inlet to the outlet, and wherein the fine particles are passed to the outlet and wherein the coarse particles are internally recycled back towards an upstream end of the grinding chamber, wherein at least one of the plurality of grinding elements with the apertures therethrough provides a larger flow path therethrough for the slurry and grinding media compared to one or more of the other of the plurality of grinding elements; and wherein the total open area of the apertures of the at least one of the plurality of grinding elements providing the larger flow path is larger than the total open area of the apertures in one or more of the other of the plurality of grinding elements in the mill.

2. The attrition mill of claim 1, wherein the grinding elements comprise apertures wherein the total open area of the apertures of the at least one of the plurality of grinding elements providing the larger flow path is larger than the total open area of the apertures in one or more of the other of the plurality of grinding elements in the mill.

3. The attrition mill of claim 1, wherein the at least one grinding element that provides the larger flow path therethrough is positioned towards a downstream end of the grinding chamber.

4. The attrition mill of claim 3, wherein the plurality of the grinding elements include eight grinding elements wherein the grinding element that provides the larger flow path is positioned at element 5, 6 or 7 with element 1 positioned near the inlet end of the grinding chamber and element 8 is positioned near the outlet end of the grinding chamber.

5. The attrition mill of claim 1, wherein the mill comprises two or more grinding elements having the larger flow path therethrough.

6. An attrition mill that includes an internal structure and grinding media for grinding particles into coarse and fine particles and classifying and separating the fine particles from the coarse particles using a classification and separation stage in which fine particles are separated from coarse particles and removed from the mill along its length and coarse particles are recycled internally in the mill, the attrition mill comprising:

a grinding chamber having an elongated cylindrical side wall, an inlet positioned at or near an upstream end of the grinding chamber, an outlet positioned at or near a downstream end of the grinding chamber, an axial shaft located in the grinding chamber and extending from the upstream end to the downstream end, the axial shaft being rotatably driven, and a plurality of spaced grinding elements in the grinding chamber, each of the plurality of spaced grinding elements being concentrically mounted radially and in a perpendicular orientation relative to the axial shaft, each element being spaced from an adjacent element, each element having a front face that is perpendicular to the axial shaft and including one or more apertures or spaces therein to provide a flow path through each element for slurry and grinding media, each aperture having side walls extending from the front face of the element to a rear face of the element, the side walls being generally perpendicular to the front face, the axial shaft being exposed in between each of the elements along and through the grinding chamber from the inlet to the outlet, wherein the fine particles are passed to the outlet and wherein the coarse particles are internally recycled back towards an upstream end of the grinding chamber, wherein at least one of the plurality of grinding elements comprises said one or more apertures or spaces therein to provide an open area in the grinding element to allow a larger flow path for the slurry and grinding media, the open area being as a proportion of the grinding elements surface area one that does not allow passage of the slurry and grinding media, the proportion being in the range of from 15% to equal to or less than 100%; and wherein the total open area of the apertures of the at least one of the plurality of grinding elements providing the larger flow path is larger than the total open area of the apertures in one or more of the other of the plurality of grinding elements in the mill.

7. The attrition mill of claim 6, wherein the open area in the grinding element created to allow the larger flow path is from 20% to equal to or less than 100%.

8. The attrition mill of claim 6, wherein the open area in the grinding elements created to allow the larger flow path is from 25% to equal to or less than 100%.

9. The attrition mill of claim 6, wherein the open area in the grinding elements created to allow the larger flow path is from 30% to equal to or less than 100%.

10. The attrition mill of claim 6, wherein the mill includes two or more grinding elements having said open area in the two or more grinding elements to allow the larger flow path as a proportion of the surface area of the elements that does not allow passage of the slurry and the grinding media, with each proportion being in the range of from 15% to equal to or less than 100%.

11. The attrition mill of claim 10, wherein other grinding elements in the mill have said open area but with a lesser flow path than the said two elements having the larger open area.

12. The attrition mill of claim 6, wherein the percentage open area is calculated from the equation:

$$\% \text{ Open Area} = (\text{Area of Apertures})/(\text{Area of Full Disc} - \text{Area of Hub}) \times 100\%.$$

13. The attrition mill of claim 6 wherein the attrition mill is a horizontal shaft attrition mill.

14. The attrition mill of claim 1, wherein each grinding element has a circumference that defines an outer boundary of the grinding element, wherein at least some of the elements retain portions of its circumference and outer boundary intact with each such portion forming an arm that extends from the circumference to the shaft with the arm having a non-uniform width.

15. The attrition mill of claim 14, wherein each element retains portions of its circumference and outer boundary intact with each such portion forming an arm that extends from the circumference to the shaft with the arm having a non-uniform width.

16. The attrition mill of claim 6, wherein each element is mounted on the shaft and has a circumference that defines an outer boundary of the element, wherein at least some of the elements retain portions of its circumference and outer boundary intact with each such portion forming an arm that extends from the circumference to the shaft with the arm having a non-uniform width.

17. The attrition mill of claim 16, wherein each element retains portions of its circumference and outer boundary intact with each such portion forming an arm that extends form the circumference to the shaft with the arm having a non-uniform width.

18. The attrition mill of claim 8 wherein each element is equidistantly spaced from adjacent discs elements.

19. The attrition mill of claim 1 wherein each element is equidistantly spaced from adjacent elements.

20. An attrition mill as claimed in claim 1 wherein the grinding element that provides a larger flow path therethrough comprises a plurality of radially-extending arms.

21. An attrition mill as claimed in claim 20 wherein the grinding element has two to six radially extending arms extending from a central portion.

22. An attrition mill as claimed in claim 20 wherein the grinding element has four radially extending arm extending from a central point.

23. An attrition mill as claimed in 1 wherein the plurality of grinding elements comprises a plurality of grinding discs.

24. An attrition mill as claimed in claim 6 wherein the grinding element that provides a larger flow path therethrough comprises a plurality of radially-extending arms.

25. An attrition mill as claimed in claim 24 wherein the grinding element has two to six radially extending arms extending from a central portion.

26. An attrition mill as claimed in claim 25 wherein the grinding element has four radially extending arm extending from a central point.

27. An attrition mill as claimed in claim 6 wherein the plurality of grinding elements comprises a plurality of grinding discs.

* * * * *